US007231771B2

(12) United States Patent
McMurry et al.

(10) Patent No.: US 7,231,771 B2
(45) Date of Patent: Jun. 19, 2007

(54) APPARATUS AND METHOD FOR INDUCING EMERGENCY HYPOTHERMIA

(75) Inventors: Alan D. McMurry, North Huntingdon, PA (US); Lyn J. Yaffe, Gaithersburg, MD (US)

(73) Assignee: Ardiem Medical, Inc., Indiana, PA (US)

( * ) Notice: Subject to any disclaimer, the term of this patent is extended or adjusted under 35 U.S.C. 154(b) by 210 days.

(21) Appl. No.: 11/139,035

(22) Filed: May 26, 2005

(65) Prior Publication Data

US 2005/0274118 A1 Dec. 15, 2005

Related U.S. Application Data

(60) Provisional application No. 60/574,644, filed on May 26, 2004.

(51) Int. Cl.
*F25B 21/02* (2006.01)

(52) U.S. Cl. ..... 62/3.6

(58) Field of Classification Search ..... 62/3.2, 62/3.6, 3.62, 3.7, 129, 371, 324.2, 457.7, 62/457.9

See application file for complete search history.

(56) References Cited

U.S. PATENT DOCUMENTS

| | | | | |
|---|---|---|---|---|
| 3,858,106 A | | 12/1974 | Launius | |
| 4,326,383 A | | 4/1982 | Reed et al. | |
| 4,364,234 A | | 12/1982 | Reed | |
| 4,407,133 A | | 10/1983 | Edmonson | |
| 5,029,446 A | * | 7/1991 | Suzuki | 62/3.6 |
| 5,217,064 A | | 6/1993 | Kellow et al. | |
| 5,285,657 A | * | 2/1994 | Bacchi et al. | 62/457.9 |
| 5,301,508 A | * | 4/1994 | Kahl et al. | 62/3.62 |
| 5,319,937 A | | 6/1994 | Fritsch et al. | |
| 5,320,162 A | | 6/1994 | Seaman | |
| 5,367,879 A | * | 11/1994 | Doke et al. | 62/3.6 |
| 5,501,076 A | | 3/1996 | Sharp, III et al. | |
| 5,603,220 A | | 2/1997 | Seaman | |

(Continued)

FOREIGN PATENT DOCUMENTS

WO WO 96/07063 * 3/1996

OTHER PUBLICATIONS

Rosomoff, H. et al., "Resuscitation From Severe Brain Trauma", Crit. Care Med., vol. 21, No. 2 (Suppl.), Feb. 1996, pp. S48-S56.

(Continued)

*Primary Examiner*—Mohammad M. Ali
(74) *Attorney, Agent, or Firm*—The Webb Law Firm

(57) ABSTRACT

A thermoelectric cooler for maintaining intravenous (IV) solution within a temperature range of 1° C. to 4° C. for inducing rapid, emergency, point-of-injury, mild-to-moderate hypothermia. The thermoelectric cooler includes a substantially rectangular insulated container with a door extending in a vertical plane on the forward facing container wall and pivoting on a horizontal hinge located on the bottom edge of the door. The container is cooled by a thermoelectric module mounted between two heat exchangers and electrically powered fan assemblies. An electronic control unit controls the thermoelectric cooling module to maintain the interior of the insulated container and the IV solution within the set temperature range. The thermoelectric cooler has an exterior display panel with warning lights to visually communicate to the user if the interior temperature is in or out of range.

8 Claims, 4 Drawing Sheets

U.S. PATENT DOCUMENTS

| | | | | |
|---|---|---|---|---|
| 5,704,223 | A * | 1/1998 | MacPherson et al. | 62/3.62 |
| 5,948,012 | A | 9/1999 | Mahaffey et al. | |
| 5,987,891 | A * | 11/1999 | Kim et al. | 62/3.6 |
| 5,989,238 | A | 11/1999 | Ginsburg | |
| 6,021,642 | A * | 2/2000 | Guinn | 62/3.6 |
| 6,023,932 | A * | 2/2000 | Johnston | 62/3.5 |
| 6,073,789 | A | 6/2000 | Lundblade | |
| 6,260,360 | B1 | 7/2001 | Wheeler | |
| 6,301,901 | B1 | 10/2001 | Coffee et al. | |
| 6,393,320 | B2 | 5/2002 | Lasersohn et al. | |
| 6,519,948 | B2 | 2/2003 | Zorn | |
| 6,530,231 | B1 * | 3/2003 | Nagy et al. | 62/3.2 |
| 6,658,857 | B1 * | 12/2003 | George | 62/3.3 |
| 6,799,434 | B1 | 10/2004 | Hobbs, Jr. | |
| 6,822,861 | B2 * | 11/2004 | Meir | 361/695 |
| 6,854,275 | B2 * | 2/2005 | Evans | 62/3.2 |
| 6,981,381 | B1 * | 1/2006 | Wang et al. | 62/3.2 |

OTHER PUBLICATIONS

Markarian, G. et al., "Mild Hypothermia: Therapeutic Window after Experimental Cerebral Ischemia", Neurosurgery, vol. 38, No. 3, Mar. 1996, pp. 542-551.

Hoffman, W. et al., "Effects of graded Hypothermia on Outcome from Brain Ischemia", Neurological Research, vol. 18, No. 2, Apr. 1996, pp. 185-189.

Metz, C. et al., "Moderate Hypothermia in Patients with Severe Head Injury: Cerebral and Extracerebral Effects", Journal of Neurosurgery, vol. 85, No. 4, Oct. 1996, pp. 533-541.

Barone, F. et al., "Brain Cooling During Transient Focal Ischemia Provides Complete Neuroprotection", Neuroscience and Biobehavioral Reviews, vol. 21, No. 1, pp. 31-44 (1997).

Colbourne, F. et al., "Postischemic Hypothermia: A Critical Appraisal with Implications for Clinical Treatment", Molecular Neurobiology, vol. 14, No. 3, Jun. 1997, pp. 171-201.

Xiao, F. et al., "Peritoneal cooling for mild cerebral hypothermia after cardiac arrest in dogs", Resuscitation, vol. 30, (1995), pp. 51-59.

Sessler, D., "Deliberate Mild Hypothermia", Journal of Neurosurgical Anesthesiology, vol. 7, No. 1, Jan. 1995, pp. 38-46.

Kataoka, K. et al., "Ischemic Neuronal Damage: How Does Mild Hypothermia Modulate it?", Molecular and Chemical Neuropathology, vol. 28, (1996), pp. 191-195.

Safar, P. et al., "Selective brain cooling after cardiac arrest", Crit. Care Med., (1996), vol. 24, No. 6, pp. 911-914.

Sterz, F. et al., "Mild Resuscitative Hypothermia and Outcome After Cardiopulmonary Resuscitation", Journal of Neurosurgical Anesthesiology, vol. 8, No. 1, (1996), pp. 88-96.

Wass, C. et al., "Hypothermia-associated Protection from Ischemic Brain Injury: Implications for Patient Management", International Anesthesiology Clinics: Topics in Neuroanesthesia, vol. 34, No. 4 (1996), pp. 95-111.

Safar, P. et al., "Improved Cerebral Resuscitation From Cardiac Arrest in Dogs With Mild Hypothermia Plus Blood Flow Promotion", Stroke, vol. 27, No. 1, Jan. 1996, pp. 105-113.

Marion, D. et al. "Resuscitative hypothermia", Crit. Care Med., vol. 24, No. 2 (Suppl.), Feb. 1996, pp. S81-S89.

Dietrich, W., "The Importance of Brain Temperature in Cerebral Injury", Journal of Neurotrauma, vol. 9, Suppl. 2, (1992), pp. S475-S485.

Ginsberg, M. et al., "Therapeutic Modulation of Brain Temperature: Relevance to Ischemic Brain Injury", Cerebrovascular and Brain Metabolism Reviews, vol. 4, No. 3, (1992), pp. 189-225.

Martinez-Arizala, A. et al., "Hypothermia in Spinal Cord Injury", Journal of Neurotrauma, vol. 9, Suppl. 2, (1992), pp. S497-S505.

Weinrauch, V. et al., "Beneficial Effect of mild Hypothermia and Detrimental Effect of Deep Hypothermia After Cardiac Arrest in Dogs", Stroke, vol. 23, No. 10, Oct. 1992, pp. 1454-1462.

Kuboyama, K. et al., "Delay in cooling negates the beneficial effect of mild resuscitative cerebral hypothermia after cardiac arrest in dogs: A prospective, rendomized study", Crit. Care Med., vol. 21, No. 9, (1993), pp. 1348-1358.

Maher, J. et al., "Hypothermia as a Potential Treatment for Cerebral Ischemia", Cerebrovascular and Brain Metabolism Reviews, vol. 5, No. 4, (1993), pp. 277-300.

Safar, P., "Cerebral Resuscitation After Cardiac Arrest: Research Initiatives and Future Directions", Annals of Emergency Medicine, vol. 22, No. 2, Part. 2, Feb. 1993, pp. 324-389.

Oku, K. et al., "Mild Hypothermia After Cardiac Arrest in Dogs Does Not Affect Postarrest Multifocal Cerebral Hypoperfusion", Stroke, vol. 24, No. 10, Oct. 1993, pp. 1590-1597.

Kuboyama, K. et al., "Mild hypothermia after cardiac arrest in dogs does not affect postarrest cerebral oxygen uptake/delivery mismatching", Resuscitation, vol. 27, (1994), pp. 231-244.

Laptook, A. et al., "Modest Hypothermia Provides Partial Neuroprotection for Ischemic Neonatal Brain", Pediatric Research, vol. 35, No. 4, (1994), pp. 436-442.

Salzano, Richard P. et al., "Regional Hypothermia of the Spinal Cord Protects Against Ischemic Injury During Thoracic Aortic Cross-Clamping", The Society of Thoracic Surgeons, vol. 57, (1994), pp. 65-71.

Safar, P., "Dynamics of Brain Resuscitation After Ischemic Anoxia", Hospital Practice, Feb. 1981, pp. 67-72.

Leonov, Y. et al., "Mild Cerebral Hypothermia during and after Cardiac Arrest Improves Neurologic Outcome in Dogs", Journal of Cerebral Blood Flow and Metabolism, vol. 10, (1990), pp. 57-70.

Minamisawa, H. et al., "The Effect of Mild Hyperthermia and Hypothermia on Brain Damage Following 5, 10 and 15 Minutes of Forebrain Ischemia", American Neurological Association, (1990), pp. 26-33.

Tisherman, S. et al. "Therapeutic Deep Hypothermic Circulatory Arrest in Dogs: A Resuscitation Modality for Hemorrahagic Shock with 'Irreparable' Injury", The Journal of Trauma, vol. 30, No. 7, Jul. 1990, pp. 836-847.

Tisherman, S. et al., "Deep Hypothermic Circulatory Arrest Induced During Hemorrhagic Shock in Dogs: Preliminary Systemic and Cerebral Metabolism Studies", Current Surgery, Sep. 1990, pp. 327-330.

Leonov, Y. et al., "Moderate Hypothermia After Cardiac Arrest of 17 Minutes in Dogs: Effect on Cerebral and Cardiac Outcome", Stroke, vol. 21, No. 11, Nov. 1990, pp. 1600-1606.

Sterz, F. et al., "Mild Hypothermic Cardiopulmonary Resuscitation Improves Outcome after Prolonged Cardiac Arrest in Dogs", Critical Care Medicine, vol. 19, No. 3, (1991), pp. 379-389.

Long, R., "Regional Cranial Hypothermia in the Prevention of Cerebral Ischemic Damage During Carotid Occlusion", Review of Surgery, vol. 23, No. 3, May 1996, pp. 226-228.

White, R. et al., "Profound selective cooling and ischemia of primate brain without pump of oxygenator", Surgery, vol. 66, No. 1, Jul. 1969, pp. 224-232.

Safar, P., "Resuscitation after global brain ischemia-anoxia", Crit. Care Med., vol. 6, No. 4, (1978), pp. 215-227.

Ping, F. et al., "Protection of the Brain from Hypoxia: A Review",Canad. Anaesth. Soc. J., vol. 25, No. 6, Nov. 1978, pp. 468-473.

* cited by examiner

APPARATUS AND METHOD FOR INDUCING EMERGENCY HYPOTHERMIA

CROSS REFERENCE TO RELATED APPLICATION

This application claims the benefit of U.S. Provisional Application No. 60/574,644, filed May 26, 2004.

BACKGROUND OF THE INVENTION

1. Field of the Invention

The invention relates to a thermoelectric cooler, particularly for cooling intravenous (IV) solution. More particularly, the present invention relates to a transportable, wall-outlet powered cooler which maintains IV solution for the purpose of rapidly inducing emergency therapeutic hypothermia, applicable both in an emergency room environment and in an emergency vehicle at the point of injury.

2. Description of Related Art

Interest in therapeutic hypothermia intervention continues to increase as a result of hypothermia's protective impact during ischemic events. Clinical evidence demonstrates that patients suffering severe brain trauma or ischemia from myocardial infarction or stroke have improved medical outcomes if core temperature is lowered below normal body temperature (37° C.). Hypothermia was employed during the 1980s and 1990s in a range of surgical procedures to protect the brain, heart and other vital organs from ischemia, but did not gain broad acceptance as a standard of care for specific applications. Only recently has therapeutic hypothermia generated increased interest based on several significant clinical studies. Therapeutic hypothermia may ultimately become an important therapeutic adjunct in acute stroke, acute myocardial infarction, cardiac arrest, head trauma, and specific surgical procedures requiring neuroprotection.

Currently, expanded clinical trials for therapeutic hypothermia are ongoing, and broader applications for thermal management devices are anticipated. Based on several early clinical trials, the American Heart Association published a recommendation in June of 2003 that victims of ventricular fibrillation (VF) cardiac arrest may be helped by immediate mild hypothermia. Approximately 300,000 cardiac arrest cases occur in the United States each year and about 75,000 make it to the hospital. Studies are now demonstrating that mild cooling in cardiac arrest cases improve survivals about 15% (up from 40% to 55%), and further cooling of hearts after myocardial infarction, and not just arrests/defibrillations, may also be very beneficial.

In addition to cardiac arrest, multi-center clinical trials for mild hypothermia benefits in stroke treatment are also currently ongoing in the United States. Annually, there are approximately 500,000 stroke victims in the United States that could benefit from immediate cooling treatments. Also, about 180,000 trauma deaths occur in the United States annually and 50% of these deaths occur within the first few hours, with exsanguination being the common cause. All of these cases could potentially benefit from immediate, life-saving, hypothermia protocols if a point-of-injury apparatus was available.

One method shown to be effective for quickly inducing mild hypothermia is administering cold IV solution in the form of a bolus. One or two liters of IV solution or other appropriate fluid, chilled to a range of 1° C. to 4° C., and given as a bolus, can quickly lower an individual's core temperature to 34° C. or less. The generally accepted range of mild-to-moderate hypothermia is 30° C. to 34° C., and it appears the earlier that cooling is initiated, the better the outcome. Emergency cooling could ultimately benefit the following conditions: acute myocardial infarction, stroke, traumatic hemorrhagic shock, traumatic brain injury, spinal cord injury, septic shock, neuroprotection, fever control and status epilepticus.

Portable thermoelectric coolers are widely used by motorists and outdoorsmen, plus they have a variety of medical applications. An example is shown in U.S. Pat. No. 4,326,383, which shows a lightweight, compact, portable thermoelectric refrigerator for cooling and storing perishable foods, having power provided by either a 12 volt DC automobile outlet or a 110 volt AC standard wall outlet. A further example is U.S. Pat. No. 6,799,434, which shows a battery powered, portable, thermoelectric cooler for food and beverage items, having an internally located user temperature control and display panel. Moreover, U.S. Pat. No. 6,301,901 discloses a portable thermoelectric cooler and warmer for food and beverage items, having power provided by either a 12 volt DC automobile outlet or a 110 volt AC standard wall outlet. An additional example is U.S. Pat. No. 5,217,064, which shows a portable, temperature controlled, thermoelectric storage device for pharmaceuticals, powered by rechargeable batteries and having a visual warning to indicate when contents have been out of a set temperature range for a predetermined length of time. While these devices may be appropriate for the particular purpose cited, or for general use, they would not be as suitable for the purposes of cooling and maintaining bags of IV solution at a temperature appropriate for therapeutic hypothermia.

Typical thermoelectric enclosures are insulated containers having walls upstanding from a base to define a top opening to which is mounted a removable or hinged door. Thus, such coolers are typically rectangular with two sidewalls and two end walls, and have a pivoting door extending in a horizontal plane and pivoting about a horizontal axis.

Other thermoelectric containers have a door that extends in a vertical plane and pivots about a vertical axis. Further, as in U.S. Pat. No. 6,073,789, other thermoelectric containers have a door that is mountable in multiple configurations. Many thermoelectric containers can be positioned on multiple sides which permits changing the direction in which the door pivots by simply inverting the position of the container. However, the intended use of a thermoelectric cooler often dictates supporting it in only one position that will allow internal access, such as locating the container on a shelf or in a storage compartment. Further, the container may be optimally used in only one position because of the manner stored items are maintained, such as on internal shelves or compartments.

Thermoelectric units or engines further complicate the configuration of the thermal container and its door position. Such containers are well known and include a DC thermoelectric unit which either heats or cools the interior compartment depending upon the polarity of the connection to the power source. The thermoelectric unit often includes a fan for drawing air through an air intake opening, distributing conditioned air within the compartment, and venting air to the outside through an exhaust opening, or may include both an internal fan for circulating conditioned air and a second fan for the circulating air across an external heat exchanger.

The thermoelectric unit is usually provided in one of the end walls of the container or in the door, dependent on its intended use and position. In any situation, consideration must be given to the vent openings or external heat exchanger and fan in order to provide adequate circulation. If the container is to be used as a typical ice chest or storage cooler in an automobile while traveling, configuration of the door opening and thermoelectric unit is straightforward and uncomplicated. More consideration must be given to the configuration of a thermoelectric cooler to be stored in emergency vehicles where storage on a shelf or inside a cabinet is likely, but quick access for emergency situations is still required.

SUMMARY OF THE INVENTION

Accordingly, it is an object of the invention to provide a thermoelectric container for cooling and maintaining bags of IV solution, or other appropriate fluid, within a set temperature range of 1° C. to 4° C. having power provided by a standard 110 volt AC wall outlet with a power cord and adapter. The cooler, powered in such a manner, is suitable for use in an emergency vehicle, such as an ambulance, and in a hospital emergency room or clinic.

Accordingly, it is an object of the invention to provide a thermoelectric container which can be stored on a shelf or in a cabinet, having a door extending in a vertical plane on the forward facing container wall which pivots on a horizontal hinge located on the bottom edge of the door to allow rapid access to cooled bags of IV solution for emergency use.

Described in its preferred embodiment, the invention provides a portable thermoelectric cooler which includes a storage compartment enclosed by an essentially rectangular housing composed of rigid insulating foam covered by a hard plastic surface. The storage compartment has an open front wall coverable by an insulated door attached to the housing by a horizontal hinge located at the bottom edge of the door and bottom edge of the front opening. In one of the end walls, there is an opening for insertion of a thermoelectric module having an active thermoelectric cooling device positioned between and in intimate thermal contact with two aluminum heat exchangers. The thermoelectric module is disposed in the wall opening such that it fills the opening, one heat exchanger extending into the interior storage compartment and the second heat exchanger disposed to the exterior of the end wall. A fan is mounted on the interior-side heat exchanger to circulate cooled air in the storage space and cool the contents to the required temperature. A second fan is mounted on the external heat exchanger to assist in dissipating the heat removed from the internal heat exchanger. Both heat exchangers are composed of an aluminum base with a plurality of fins.

Mounted on or in the opposite wall from the thermoelectric module is the electronic control unit which includes the electronic temperature controls, external warning lights to inform the user if interior temperature is in or out of prescribed range and if power is on or off. Mounted on the interior of the cooler, but electrically connected to the electronic control unit, is a temperature sensor. A connector for connecting to the external power source is mounted in one wall of the cooler, having the connection end disposed to the exterior for insertion of the power cord connector.

The combination of elements provided in the described embodiment of the invention results in a lightweight efficient thermoelectric cooler having a storage volume, ease of access, and cooling capacity for maintaining bags of IV solution, or other appropriate fluid, within a set temperature range for the specific purpose of inducing rapid, emergency, point-of-injury, mild-to-moderate hypothermia.

It is an object of the invention to provide a thermoelectric cooler which may be easily transported between locations, and which is not unduly large or heavy. Accordingly, the thermoelectric cooler described is small and lightweight, and may be easily transported between locations by the average adult. When, being transported by a person, cooling is passive as the cooler does not use batteries to power the thermoelectric unit.

It is another object of the invention to provide a thermoelectric cooler which may be located, powered, and transported in an emergency vehicle or be located and powered in an emergency room of a hospital or clinic. Accordingly, the cooler is powered with a 110 volt AC standard wall outlet, available in both ambulances and emergency rooms, using an appropriate grade power cord.

It is another object of the invention to provide a thermoelectric cooler having a means for maintaining the interior of the container within a temperature range of 1° C. to 4° C. Accordingly, when the interior temperature is higher than the set-point (for instance 2° C.), the electronic control unit activates the thermoelectric cooling module to cool the interior, and remains activated until the temperature lowers to the set point. If the interior temperature is lower than the set point, the cooling device is deactivated by the electronic control unit and remains in that state until the temperature is higher than the set point, thereby providing a cooler having means for maintaining the interior of the portable cooler within a constant temperature range of 1° C. to 4° C.

It is another object of the invention to provide a thermoelectric cooler which may be easily located on a shelf or in a compartment and provides rapid access for emergency use. Accordingly, the thermoelectric cooler described has a door extending in a vertical plane on the forward facing container wall and pivoting on a horizontal hinge located on the bottom edge of the door. When located on a shelf or in a compartment, the thermoelectric unit will continue to function properly and maintain the interior of the container within the proper temperature range.

It is another object of the invention to provide a thermoelectric cooler wherein the user is warned if the interior temperature of the container is not within the prescribed range of 1° C. to 4° C. Accordingly, the thermoelectric cooler has external warning lights to visually communicate if the interior temperature is in or out of range.

It is yet another object of the invention to provide a thermoelectric cooler for maintaining bags of IV solution, or other appropriate fluid, within a set temperature range for the specific purpose of inducing rapid, emergency, point-of-injury, mild-to-moderate hypothermia, to a person suffering brain trauma, cardiac arrest, stroke, or other trauma. Accordingly, the cooler has the controls and cooling capacity to maintain the IV solution at 1° C. to 4° C. and allow quick access to the IV bags by the user for infusing as a bolus to the patient to quickly lower core temperature and induce hypothermia.

It is an additional object of the invention to provide a portable cooler which is not unduly expensive. Accordingly, the materials from which the portable cooler is constructed are readily available and its cost is not prohibitive.

Further objects of the invention will become apparent in the detailed description of the invention which follows.

Toward the accomplishment of the above and related objects, the invention may be embodied in the form illustrated in the accompanying drawings. However, the drawings are illustrative only and variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENT

Figure 1:
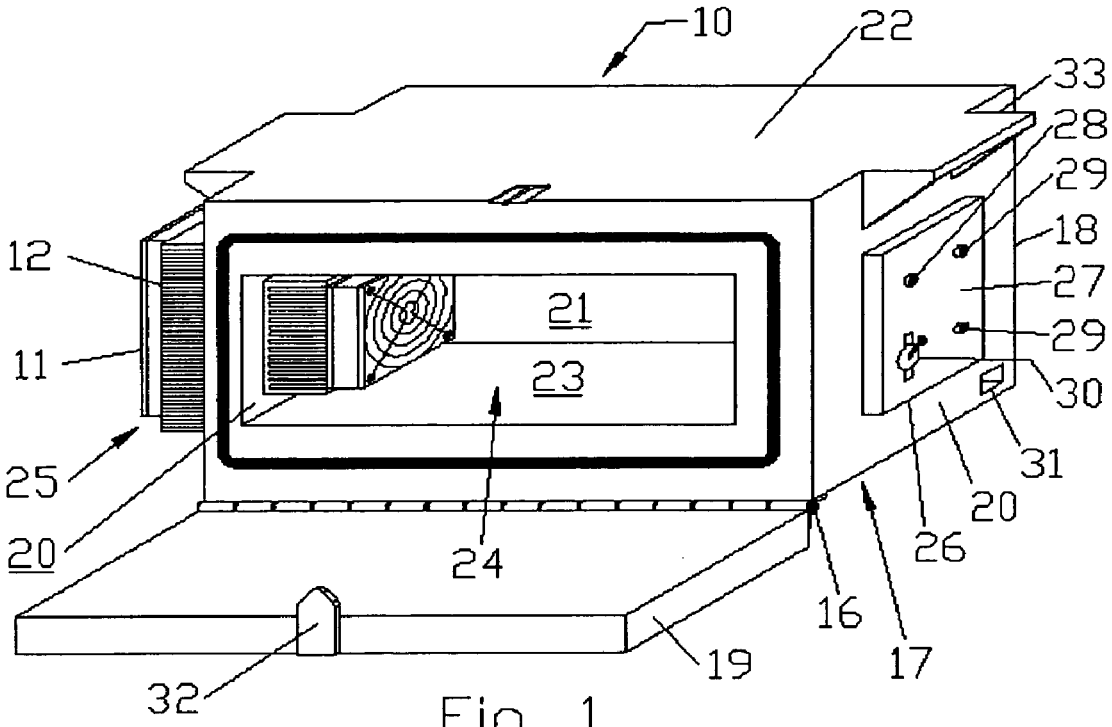
FIG. 1 is a perspective view of a thermoelectric cooler in an open position of the present invention.
Figure 2:
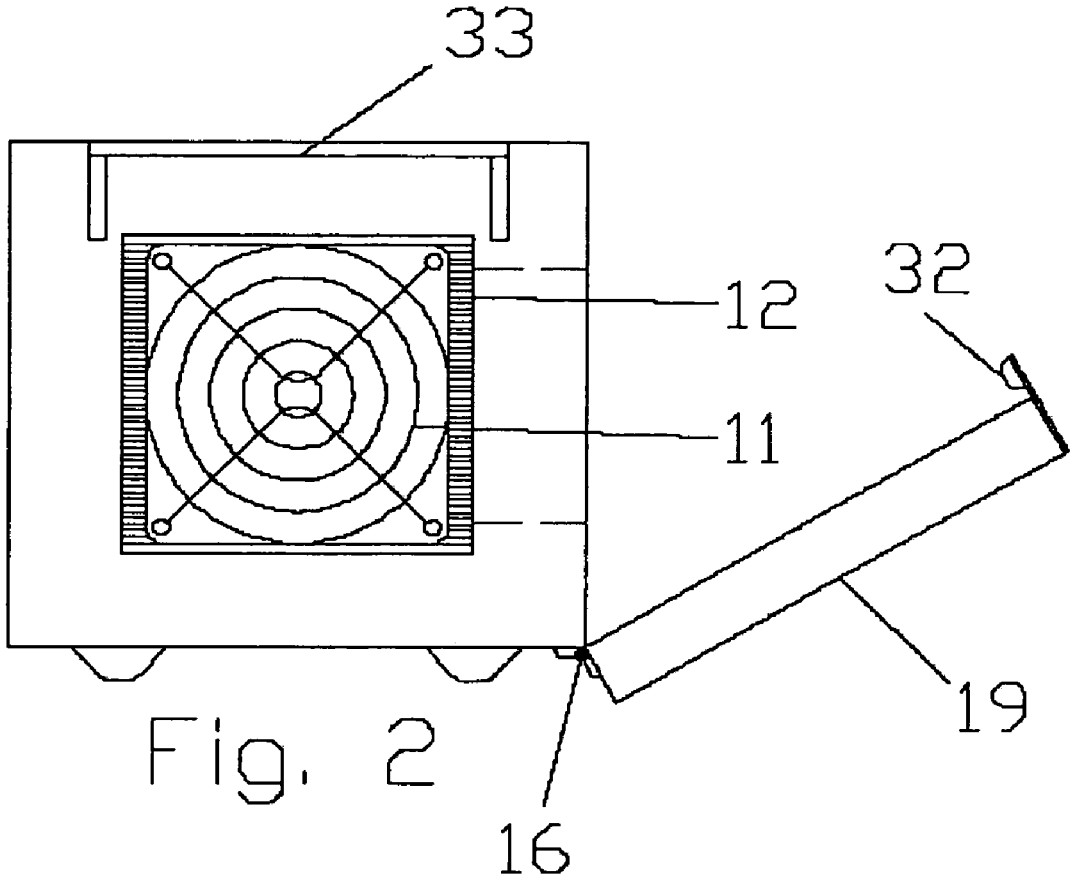
FIG. 2 is an end view of a thermoelectric cooler illustrating the thermoelectric module of the present invention.
Figure 3:
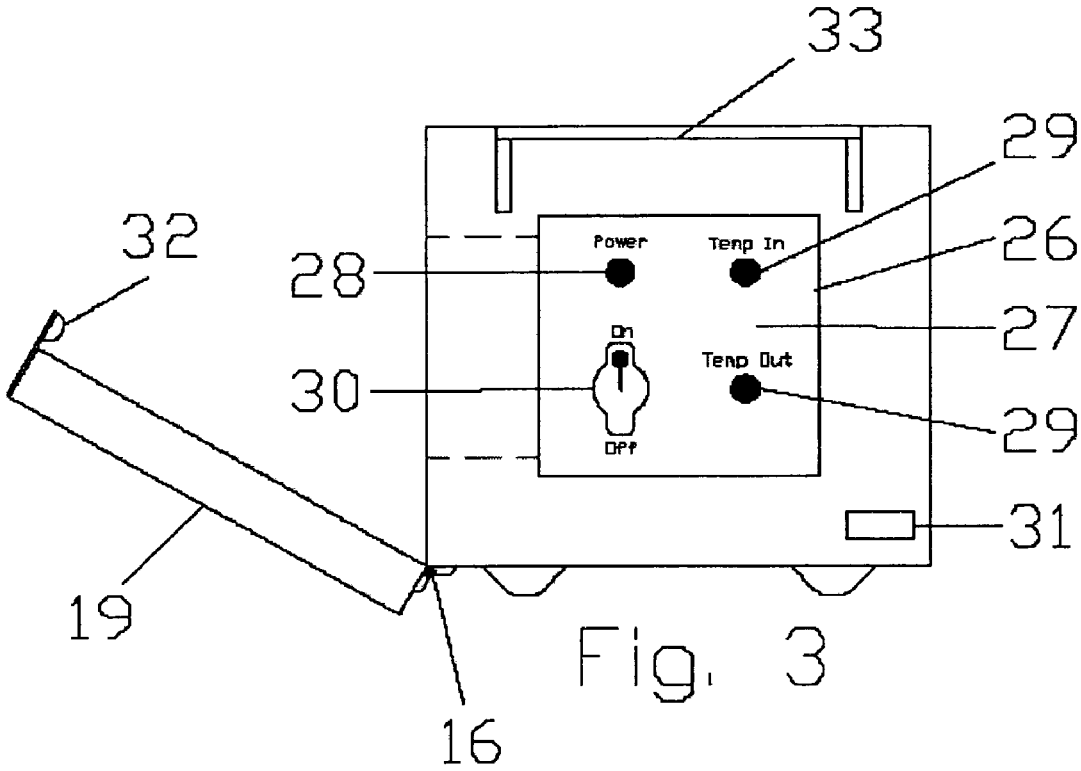
FIG. 3 is an end view of the thermoelectric cooler illustrating the electronic control unit of the present invention.
Figure 4:
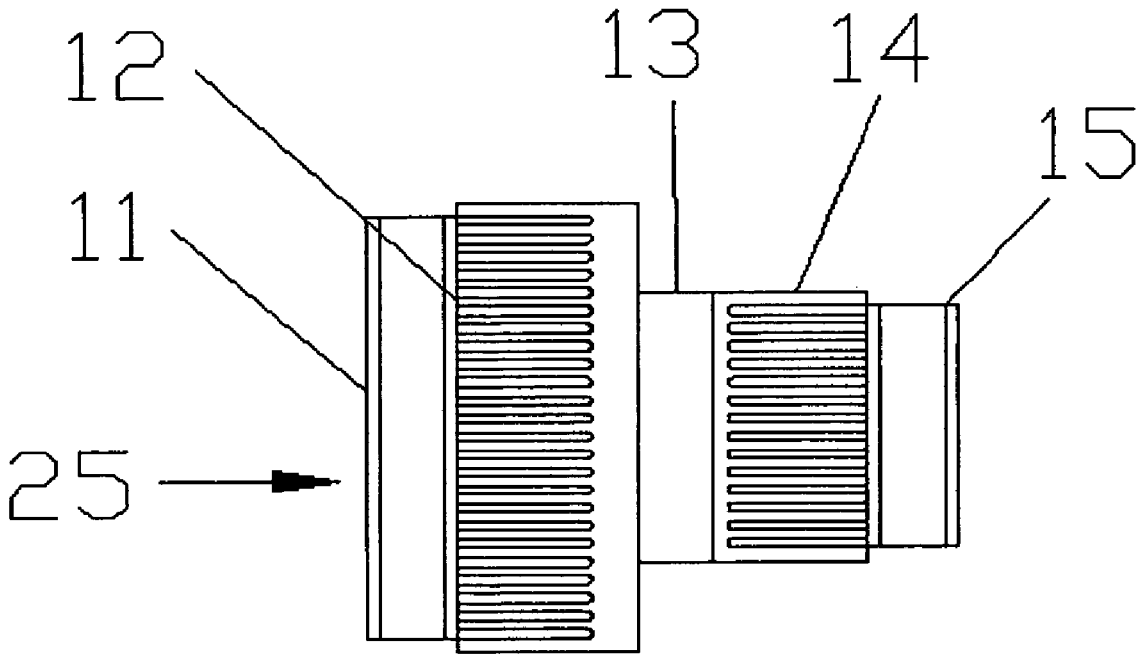
FIG. 4 is a section view of the thermoelectric module of the present invention.

The embodiment shown in FIG. 1 illustrates a thermoelectric cooler 10 for maintaining bags of IV solution or other appropriate fluid at a temperature of 1° C. to 4° C., which includes a substantially hollow and rectangular insulated container 17 having an interior volume, and an associated thermoelectric module 25 (cf. FIG. 4) for actively cooling the interior volume. The insulated container 17 has a storage compartment 18, a door 19, and at least one hinge 16 which pivotally attaches the door 19 to the storage compartment 18. The storage compartment 18 has two end walls 20, a back wall 21, a bottom 23, a top 22, and a substantially rectangular opening 24 in proximity to the front of the storage compartment 18 for selectively providing access to the items contained within the storage compartment 18. The two end walls 20, the back wall 21, the bottom 23, the top 22, and the door 19, define the interior volume off the thermoelectric cooler 10. Each of the walls 20 and 21, the bottom 23, the top 22, and the door 19 has a hard and durable externally oriented surface facing onto the exterior of the thermoelectric cooler 10, and a hard and durable internally oriented surface facing onto the interior volume of the thermoelectric cooler 10. The space between the externally oriented surfaces and the internally oriented surfaces is filled with a high density insulating material (not shown). The container 17 is insulated so that heat from the exterior of the container 17 will not easily enter into the interior volume of the insulated container 17. The insulation may be provided by foam or sheets of polymer material.

The insulated container 17 has an open position wherein the door 19 is swiveled away from the storage compartment 18 upon the at least one hinge 16, and a closed position wherein the door 19 is swiveled toward the storage compartment 18 upon the at least one hinge 16 and secured in place by at least one latch 32 in order that the opening 24 at the front of the storage compartment 18 is sealed by the door 19. The insulated container 17 is selectively opened in order to insert and remove IV solution from the storage compartment 24. When the door 19 is closed and latched to the storage compartment 18, an isolated thermally insulated chamber is formed, which stores therein IV solution.

A thermoelectric module 25, which exploits the Peltier effect for active cooling, is mounted in an end wall 20 of the storage compartment 18. The thermoelectric module 25 consists of a Peltier effect element 13, heat exchangers 12, 14, and electrically powered fans 11, 15. The Peltier effect element 13 is sandwiched between an inner heat exchanger 14 and an outer heat exchanger 12, both of which are preferably made of aluminum. The heat exchangers 12, 14 are constructed with fins to increase surface area for heat transfer. Each heat exchanger 12, 14 is in intimate thermal contact with a face of the Peltier effect element 13. An electrically powered inner fan 15 is mounted on the inner heat exchanger 14. The inner fan 15 is arranged to circulate air inside of the thermally isolated chamber in the insulated container 17 against the inner heat exchanger 14, transferring heat energy in the air to the inner heat exchanger 14 thereby cooling the chamber and its contents. The fan 11 mounted on the outer heat exchanger 12 is arranged to drive atmospheric air through the outer heat exchanger 12, thereby transferring the heat energy removed from the thermally isolated chamber by the inner heat exchanger 14 to the outer heat exchanger 12 and then to the environment's atmospheric air. The electrically powered fans 11, 15 continuously operate when power is supplied to the thermoelectric module 25. The thermoelectric module 25 maintains the temperature of the thermally isolated chamber in the insulated container 17 within a range of 1° C. to 4° C.

An electronic control unit 26 receives signals from a temperature sensor (not shown) located in the interior chamber of the container 17 opposite the location of the inner heat exchanger 14. The electronic control unit 26 checks the temperature of the interior chamber of the container 17 against the set-point and provides power to the thermoelectric module 25 if cooling is required or turns the power off if cooling is not required. Disposed within the electronic control unit 26 is a printed circuit to control the operation of the fans 11, 15 and the Peltier effect element 13 of the thermoelectric module 25. Connected to the electronic circuit is a suitable DC power supply (not shown) that supplies, in this embodiment, direct current for the electronic circuit. Power to the DC power supply is provided by a suitable grade power cord (not shown) through a connector jack 31 located on the exterior of the container 17. The power cord is connected to a standard 110 volt AC wall outlet, available in both ambulances and emergency rooms. When a power switch 30 is turned on, a suitable warning light 28 is energized on a display panel 27.

The electronic control unit 26 has a display panel 27 to communicate information to the user about the status of the thermoelectric cooler 10. The display panel 27 is located on an externally oriented surface of one of the end walls 20. It is contemplated that the display panel 27 may be positioned at alternate locations on the container 17. The display panel 27 has an on-off power switch 30 for selectively powering the thermoelectric cooler 10, a warning light 28 to indicate when power is on, and warning lights 29 to indicate when the temperature of the interior chamber is within the range of 1° C. to 4° C. and when the temperature of the interior chamber is outside of the 1° C. to 4° C. range.

The externally oriented surfaces of the two end walls 20 of the insulated container 17 have handles 33 attached thereunto to enable the user to easily pick up by the handles 33 and transport the thermoelectric cooler 10. The thermoelectric cooler 10 is lightweight and small enough to be easily carried by an average adult.

In use, the thermoelectric cooler 10 is positioned on a shelf, in a cabinet, on the floor, or any other location convenient to the user. The bottom 23 of the thermoelectric cooler 10 is placed on a horizontal support structure. The user provides power to the thermoelectric cooler 10 by activating the power switch 30 located on the display panel 27. The user is able to readily determine if the temperature of the interior chamber of the insulated container 17 is within the prescribed range by viewing the warning lights 29. The true temperature of the IV solution cannot be determined by this invention.

In conclusion, herein is presented a thermoelectric cooler having an Peltier effect cooling device for maintaining IV solution, or other appropriate fluid, at a temperature of 1° C. to 4° C., for the specific purpose of inducing rapid, emergency, point-of-injury, mild-to-moderate hypothermia. The invention is illustrated by example in the drawing figures, and throughout the written description. It should be understood that numerous variations are possible while adhering to the inventive concept. Such variations are contemplated as being a part of the present invention.

Although the present invention has been described with reference to a preferred embodiment, further modifications and improvements will be apparent to one skilled in the art based on the present teachings without departing from the spirit and scope of the present invention as defined herein and in the following claims.

What is claimed is:

1. A thermoelectric cooler for maintaining intravenous solution, or other appropriate fluid, within a set temperature range for the specific purpose of inducing rapid, point-of-injury, mild-to-moderate hypothermia, comprising:

an insulated container comprising a storage compartment having two generally parallel end walls, generally parallel top and bottom walls, and a back wall, each of the walls and a door having internally oriented and externally oriented surfaces, the top, bottom, and end walls having front edge surfaces, the storage compartment having an opening in proximity to the front, and a generally rectangular door having at least one horizontally positioned hinge which pivotally attaches the bottom edge of the door to the bottom front edge of the storage compartment, the door in the closed position sealing the opening at the front of the storage compartment, and the storage compartment and the door in the closed position together defining an interior volume of the thermoelectric cooler;

a thermoelectric cooling device for cooling the interior volume of the insulated container, having a cooling element mounted between interior and exterior heat exchangers, each with an associated electrically powered fan;

an electronic control unit with an associated temperature sensor, for detecting and maintaining the temperature of the interior volume within a set temperature range;

a display panel positioned on the insulated container, for enabling the user to control the operation of the cooling device, having an on-off power switch for selectively powering the cooling device, a warning light to indicate when power is on, a warning light to indicate when the temperature of the interior volume is within the set temperature range, and a warning light to indicate when the temperature of the interior volume is outside temperature range; and a connector jack positioned on the insulated container with an associated power cord to provide electrical power to the thermoelectric cooler by connection to a standard electrical outlet.

2. The thermoelectric cooler as recited in claim 1, wherein the thermoelectric cooling device is positioned within one of the end walls of the insulated container, having one heat exchanger and fan combination disposed in the interior volume and the second heat exchanger and fan combination disposed to the exterior of the insulated container.

3. The thermoelectric cooler as recited in claim 2, wherein the insulated container is substantially rectangular, having two end walls, a top and bottom wall, a back wall, and a substantially rectangular opening in proximity to the front, wherein the two end walls, the top and bottom walls, the back wall, and the door, define the interior volume of the thermoelectric cooler, and wherein each of the walls and the door has an externally oriented surface facing onto the exterior of the thermoelectric cooler, and an internally oriented surface facing onto the interior of the thermoelectric cooler.

4. The thermoelectric cooler as recited in claim 3, wherein the display panel is positioned upon an externally oriented surface of one of the walls.

5. The thermoelectric cooler as recited in claim 4, wherein the externally oriented surfaces of the two end walls of the insulated container each have a handle attached thereunto, for enabling the user to easily transport the thermoelectric cooler between locations.

6. The thermoelectric cooler as recited in claim 5, wherein the bottom edge of the door is pivotally attached to the bottom edge of the insulated container by at least one horizontally positioned hinge.

7. The thermoelectric cooler as recited in claim 6, wherein the cooling device is a Peltier effect active cooling element.

8. The thermoelectric cooler as recited in claim 6, wherein power is provided by a standard 110 volt AC wall outlet.

* * * * *

UNITED STATES PATENT AND TRADEMARK OFFICE

CERTIFICATE OF CORRECTION

PATENT NO. : 7,231,771 B2
APPLICATION NO. : 11/139035
DATED : June 19, 2007
INVENTOR(S) : McMurry et al.

It is certified that error appears in the above-identified patent and that said Letters Patent is hereby corrected as shown below:

Face of the Patent, See item (56) References Cited, OTHER PUBLICATIONS, column 2, first reference, line 2, "vol. 21" should read -- vol. 24 --

Face of the Patent, See item (56) References Cited, OTHER PUBLICATIONS, page 2, column 2, third to last entry, "pump of" should read -- pump or --

Signed and Sealed this

Fourth Day of December, 2007

JON W. DUDAS
*Director of the United States Patent and Trademark Office*